US006179896B1

(12) United States Patent
Kepplinger et al.

(10) Patent No.: US 6,179,896 B1
(45) Date of Patent: Jan. 30, 2001

(54) PROCESS FOR PRODUCING LIQUID PIG IRON OR SEMIFINISHED STEEL PRODUCTS FROM ORE

(75) Inventors: Leopold Werner Kepplinger, Leonding; Felix Wallner; Johannes-Leopold Schenk, both of Linz, all of (AT)

(73) Assignee: Deutsche Voest-Alpine Industrieanlagenbau GmbH, Dusseldorf (DE)

( * ) Notice: Under 35 U.S.C. 154(b), the term of this patent shall be extended for 0 days.

(21) Appl. No.: 09/101,150

(22) PCT Filed: Nov. 5, 1997

(86) PCT No.: PCT/AT97/00237

§ 371 Date: Jul. 1, 1998

§ 102(e) Date: Jul. 1, 1998

(87) PCT Pub. No.: WO98/21370

PCT Pub. Date: May 22, 1998

(30) Foreign Application Priority Data

Nov. 8, 1996 (AT) ..... 1962/96
Nov. 8, 1996 (AT) ..... 1963/96

(51) Int. Cl.[7] ..... C21B 11/00

(52) U.S. Cl. ..... 75/492; 75/571; 75/573; 266/44

(58) Field of Search ..... 75/445, 446, 491, 75/492, 469, 571, 573; 266/44

(56) References Cited

U.S. PATENT DOCUMENTS 4,564,389 * 1/1986 Yamaoka et al. ..... 75/492
5,759,232 * 6/1998 Takahashi et al. ..... 75/469

FOREIGN PATENT DOCUMENTS 0195770 9/1986 (EP) .
0217331 4/1987 (EP) .
0576414 12/1993 (EP) .
0594557 4/1994 (EP) .

* cited by examiner

*Primary Examiner*—Melvyn Andrews
(74) *Attorney, Agent, or Firm*—Ostrolenk, Faber, Gerb & Soffen, LLP

(57) ABSTRACT

In a method of producing molten pig iron (9) or steel pre-products from lump ore which in at least one reduction zone is reduced to partially and/or completely reduced sponge iron (4) in a shaft furnace, the sponge iron (4) is melted down in a melt-down gasifying zone (8) of a melter gasifier (1) under supply of carbon-containing material (2) and oxygen and while simultaneously forming a reducing gas. To ensure that there will be a specific gap volume in the bed (13) of solid carbon carriers (2) even when charging fine-particle sponge iron (14) and hence that the bed (13) of solid carbon carriers (2) will be thoroughly flown through by gas, at least the sponge iron (4) is charged to the melt-down gasifying zone (8) discontinually, under formation of areas (14) of piled-up sponge iron which are embedded in the bed (13) of carbon carriers (2) and which are superposed and which are separated by solid carbon carriers (2), wherein each of the areas (14) of piled-up sponge iron while sparing a cross section zone (15) of the melt-down gasifying zone (8) extends over the cross section of the same and wherein the reducing gas forming the melt-down gasifying zone (8) flows past the areas (14) of piled-up sponge iron under melting of the same and upwards through the cross section zones (15) that are free from sponge iron and formed from carbon carriers (2), and flows through these zones.

10 Claims, 1 Drawing Sheet

PROCESS FOR PRODUCING LIQUID PIG IRON OR SEMIFINISHED STEEL PRODUCTS FROM ORE

Figure 1:
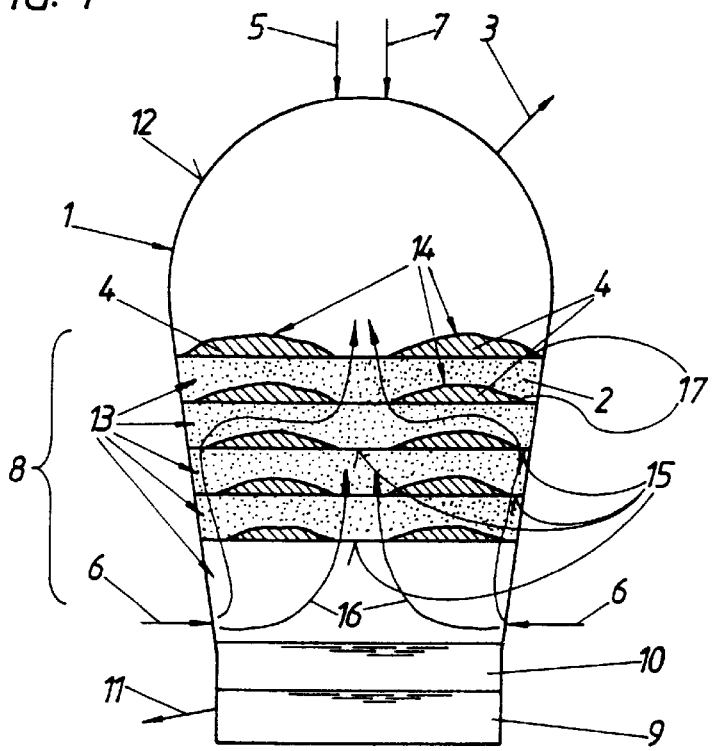

The invention relates to a method of producing molten pig iron or steel pre-products from an ore which in at least one reduction zone is reduced to partially and/or completely reduced sponge iron which is melted down in a melt-down gasifying zone of a melter gasifier under supply of carbon-containing material and oxygen and while simultaneously forming a reducing gas in a bed formed of solid carbon carriers, optionally upon previous complete reduction.

A method of this kind is known for instance from EP-A-0 576 414. There, the sponge iron partially or completely reduced from lump ore in a shaft furnace from the shaft furnace passes into the bed formed of solid carbon carriers in the melter gasifier via discharge worms, namely in roughly uniform distribution. The reducing gas formed in the melt-down gasifying zone flows upward through the bed of solid carbon carriers which exhibits a specific gap volume and it melts the sponge iron charged into the bed. To be effective, this method requires a certain minimum gap volume of the bed of solid carbon carriers.

A method of the kind initially described is further known from EP-A-0 594 557, for instance, according to which fine ore is reduced to sponge iron by the fluidized bed method. Herein, the partially or completely reduced sponge iron through forced conveyance realized by means of injectors passes into the bed formed of solid carbon carriers, in roughly uniform distribution. Here, too, the reducing gas formed in the melt-down gasifying zone flows upward through the bed of solid carbon carriers which exhibits a specific gap volume and it melts the sponge iron charged into the bed. For this method to be effective, a certain minimum gap volume of the bed of solid carbon carriers is necessary.

When using solid carbon carriers having a broad range of grain sizes or having a fines content, the gap volume of the bed, which is necessary for uniform gas distribution, is limited from the outset. If, in such a bed of solid carbon carriers, sponge iron is charged in a uniformly distributed manner and if, moreover, the sponge iron is partially of a rather fine-grained nature, i.e. is provided with a fines portion, the gap volume of the bed of solid carbon carriers is decreased and satisfactory flowing of gas through the bed will no longer be ensured. Inside the bed, a localized passage may be formed through which the reducing gas forming in the bed will flow upward, in which case, however, large areas of the bed will no longer be flown through by gas at all, or not sufficiently.

The invention aims at avoiding these disadvantages and difficulties and has as its object to provide a method of the initially described kind, in which effective formation of reducing gas will be ensured by satisfactory gas flow through the entire bed even at a low gap volume of the bed of solid carbon carriers and at the same time efficient melting of the charged sponge iron will take place. In accordance with the invention, this object is achieved in that at least the sponge iron is in contrast to the prior art no longer charged to the bed of solid carbon carriers in a uniformly distributed manner but is charged to the melt-down gasifying zone discontinually, under formation of areas of piled-up sponge iron which are embedded in the bed of carbon carriers and which are superposed and which are separated by solid carbon carriers, wherein each of the areas of piled-up sponge iron while sparing a cross section zone of the melt-down gasifying zone extends over the cross section of the same and wherein the reducing gas forming in the melt-down gasifying zone flows past the areas of piled-up sponge iron under melting of the same and upwards through the cross section zones that are free from sponge iron and formed from carbon carriers, and flows through the said zones.

In this way, no decrease will be caused in the gap volume by the sponge iron being charged, so that the bed of solid carbon carriers can be thoroughly flown through by gas at all times even at a small gap volume and in spite of charging dust-like sponge iron. Between the areas of piled-up sponge iron there will thus remain areas of the bed of solid carbon carriers which can be thoroughly flown through by gas, thus ensuring that sufficient amounts of reducing gas will be formed by gasification of the carbon carriers in any event.

According to a preferred embodiment, the sponge iron is charged to the melt-down gasifying zone under formation of circular areas of piled-up sponge iron, wherein advantageously the sponge iron is charged to the melt-down gasifying zone under formation of a single area of piled-up sponge iron per cross section level and with the area of piled-up sponge iron extending centrally over the cross section and forming a cross section zone shaped like a circular ring, which is free from sponge iron.

According to another preferred embodiment, the sponge iron is charged to the melt-down gasifying zone under formation of several areas of piled-up sponge iron that lie in a plane and are arranged at a distance from each other and thus between the areas of piled-up sponge iron yield cross section zones that are free from sponge iron.

Further it is also possible to charge the sponge iron to the melt-down gasifying zone under formation of an area of piled-up sponge iron having the shape of a circular ring lying in a plane, wherein advantageously the sponge iron is charged to the melt-down gasifying zone under formation of cross section zones that are free from sponge iron and lie outside and inside the area of piled-up sponge iron that is shaped like a circular ring.

Preferably, in addition, the solid carbon carriers are also charged to the melt-down gasifying zone non-continuously, namely by reducing the quantity or by interrupting such charging during the charging of the sponge iron.

Suitably, the charging of solid carbon carriers is stopped during the charging of the sponge iron, then the charging of the sponge iron is stopped for a specific period and for a specific period only solid carbon carriers are charged, whereupon, in turn, only sponge iron is charged for a specific period, and so on.

To ensure that the bed of solid carbon carriers in the lower area of the melt-down gasifying zone will be flown through by gas in a satisfactory manner, the areas of piled-up sponge iron are advantageously formed so as to slope gently towards their edges.

Suitably, the sponge iron is formed from fine ore in a fluidized bed process.

According to yet another embodiment, the sponge iron is formed from lump ore in a shaft furnace.

In the following, the invention will be explained in more detail by means of two exemplary embodiments, wherein FIGS. 1 and 2 respectively schematically illustrate a vertical section of a melter gasifier.

In a melter gasifier 1, a reducing gas is generated from solid carbon carriers 2, such as coal, and from oxygen-containing gas by gasification of coal, which reducing gas through a discharge duct 3 is conducted to a shaft furnace (not illustrated in detail) in which lumpy iron ore is reduced to sponge iron 4, f.i. in accordance with EP-A-0 576 414. It is also feasible for the reducing gas to be supplied to a fluidized bed reactor (not illustrated in detail) via the discharge duct 3, in which reactor fine ore is reduced to sponge iron, fi. according to EP-A-0 217 331, in a fluidized-bed zone.

The melter gasifier I is provided with a feed duct 5 for the solid carbon carriers 2, a feed duct 6 for oxygen-containing gases, a feed duct 7 for sponge iron as well as optionally feed ducts for carbon carriers, such as hydrocarbons, that are liquid or gaseous at room temperature and for burnt fluxes. In the melter gasifier 1, molten pig iron 9 and molten slag 10 collect below the melt-down gasifying zone 8 and are tapped off through a tap 11.

The iron ore that has been reduced to sponge iron 4 in the shaft furnace or in a fluidized bed reactor, is fed to the melter gasifier, optionally together with burnt fluxes, via a conveying means, for example by means of discharge worms, or through forced conveyance by means of injectors. The feed duct 6 for the solid carbon carriers 2 and the feed duct 7 for the sponge iron 4 and the discharge duct 3 for the reducing gas—namely a plurality of each—are disposed in the dome area 12 of the melter gasifier 1 in roughly radially symmetrical arrangement.

According to the invention, charging of the sponge iron 4 is effected non-continuously, wherein areas 14 of piled-up sponge iron are formed which are embedded in a bed 13 formed of the solid carbon carriers 2, such that the sponge iron is no longer uniformly distributed in the bed 13 of solid carbon carriers 2 but forms intermediate layers. These areas 14 of piled-up sponge iron, which travel downwards continuously inside the bed 13 as the gasification process of the solid carbon carriers 2 progresses, may come to rest in the bed 13 of solid carbon carriers 2 in the shape of a circular ring, as is illustrated in FIG. 1. Herein, the areas 14 of piled-up sponge iron on each cross section level form sponge-iron-free cross section zones 15 both inside and outside of these circular-ring-shaped areas. The reducing gas forming during coal gasification can thus flow through the porous bed 13 formed of solid carbon carriers 2 properly and flows past the areas 14 of piled-up sponge iron under melting of the same, as illustrated by the arrows 16. The cross section zones 15 which are free from sponge iron 4 thus form windows that can be flown through by gas properly, thereby ensuring effective coal gasification and hence sufficient formation of reducing gas. The pronounced formation of reducing gas will also entrain rapid heating and melting of the sponge iron 4.

The areas 14 of piled-up sponge iron are preferably piled such as to slope gently towards their edges 17, so that during the downward travel of the pile areas 14 the diameter of the pile areas 14 is diminished by the melting operation and even in the lower, narrower area of the melter gasifier 1 adequate flowing of gas through the bed 13 of solid carbon carriers 2 is ensured or an optionally desired increase in the size of the free cross section zones 15 is attained for better flowing-through of gas.

Figure 2:
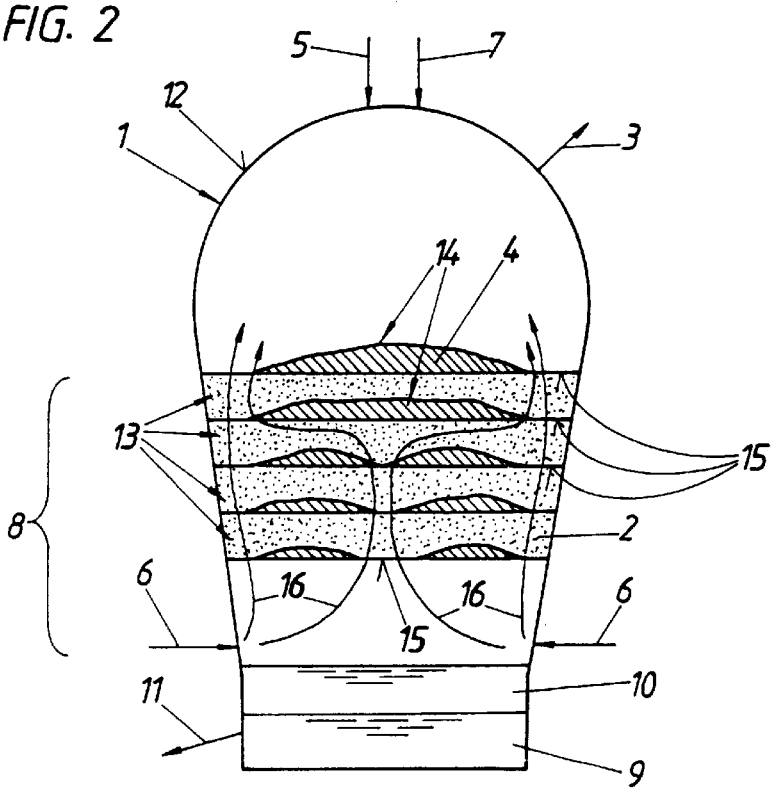

As can be seen from FIG. 2, it is also possible to form the areas 14 of piled-up sponge iron such that they have an annular shape if viewed from above, which ensures a more pronounced edge gasification of the bed 13 in the upper portion of the melt-down gasifying zone 8. As a result, there will be more rapid heating and degassing of the bed 13 of solid carbon carriers 2.

According to requirements, areas 14 of piled-up sponge iron charged in the shape of circles and circular rings may be formed, thus ensuring an optimal gasification and melting operation. According to FIG. 2, pile areas 14 shaped like circular rings are provided in the lower area of the melt-down gasifying zone 8.

For non-continuous charging of the sponge iron 4 and of the solid carbon carriers 2, various devices are conceivable, for example a distribution screen with an externally operated pivotable valve arranged in the dome area 12 of the melter gasifier 1 or a bell seal with an adjustable throat armor or a revolving chute.

Devices of this kind are known for example from blast furnace technology (cf. Ullmanns Enzyklopädie der technischen Chemie, Volume 10/Eisen, FIGS. 62A, 62D and 63), yet it should be noted that with blast furnace charging means that make it feasible to obtain a layered structure inside the blast furnace, continuous layers of the different materials, i.e. the fluxes, and of the iron ore will invariably be formed which extend over the entire cross section, whereas according to the invention the areas 14 of piled-up sponge iron are not allowed to extend over the entire cross section.

What is claimed is:

1. Method of producing molten pig iron (9) or steel pre-products from an ore which in at least one reduction zone is reduced to partially and/or completely reduced sponge iron (4) which is melted down in a melt-down gasifying zone (8) of a melter gasifier (1) under supply of carbon-containing material and oxygen and while simultaneously forming a reducing gas in a bed (13) formed of solid carbon carriers (2), optionally upon previous complete reduction, said method comprising charging at least the sponge iron (4) to the melt-down gasifying zone (8) non-continuously, under formation of areas (14) of piled-up sponge iron which are embedded in the bed (13) of carbon carriers (2) and which are superposed and which are separated by solid carbon carriers (2), wherein each of the areas (14) of piled-up sponge iron extends over a cross section of the melt-down gasifying zone, while leaving a cross sectional portion thereof free of said sponge iron, and wherein the reducing gas forming in the melt-down gasifying zone (8) flows past the areas (14) of piled-up sponge iron under melting of the same and upwards through the portions of the cross section zones (15) that are free from sponge iron and formed from carbon carriers (2), and flows through the said zones.

2. Method according to claim 1, wherein the sponge iron (4) is charged to the melt-down gasifying zone (8) under formation of circular areas (14) of piled-up sponge iron.

3. Method according to claim 1, wherein the sponge iron is charged to the melt-down gasifying zone (8) under formation of a single area (14) of piled-up sponge iron per cross section level, with the area (14) of piled-up sponge iron extending centrally over the cross section and forming a ring shaped zone (15) which is free from sponge iron (4).

4. Method according to claim 1, wherein the sponge iron (4) is charged to the melt-down gasifying zone (8) under formation of several areas (14) of piled-up sponge iron that lie in a plane and are arranged at a distance from each other and thus between the areas (14) of piled-up sponge iron yield cross section zones (15) that are free from sponge iron (4).

5. Method according to claim 1, wherein the sponge iron is formed from lump ore in a shaft furnace process.

6. Method according to claim 4, wherein the sponge iron (4) is charged to the melt-down gasifying zone (8) under formation of cross section zones (15) that are free from sponge iron (4) and lie outside and inside the ring shaped areas (14) of piled-up sponge iron.

7. Method according to claim 1, wherein, in addition, the solid carbon carriers (2) are also charged to the melt-down gasifying zone (8) discontinually by reducing the quantity or by interrupting such charging during the charging of the sponge iron.

8. Method according to claim 1, wherein the charging of solid carbon carriers is stopped during the charging of the sponge iron (4), then the charging of the sponge iron is stopped for a specific period and for a specific period only solid carbon carriers (2) are charged, whereupon, in turn, only sponge iron (4) is charged for a specific period, and so on.

9. Method according to claim 1, wherein the areas (14) of piled-up sponge iron are formed so as to slope gently towards the edges (17) of said areas.

10. Method according to claim 1, wherein the sponge iron is formed from fine ore in a fluidized bed process.

* * * * *